US008864539B1

(12) United States Patent
Watts

(10) Patent No.: US 8,864,539 B1
(45) Date of Patent: Oct. 21, 2014

(54) HANDBOARD

(71) Applicant: Steven Watts, Venice, CA (US)

(72) Inventor: Steven Watts, Venice, CA (US)

( * ) Notice: Subject to any disclaimer, the term of this patent is extended or adjusted under 35 U.S.C. 154(b) by 0 days.

(21) Appl. No.: 14/073,644

(22) Filed: Nov. 6, 2013

(51) Int. Cl.
*A63B 31/00* (2006.01)
*B63B 35/79* (2006.01)

(52) U.S. Cl.
CPC ..... *B63B 35/7906* (2013.01)
USPC ..... 441/65; 441/58; 441/56

(58) Field of Classification Search
USPC ..... 441/65, 74, 75; D21/807
See application file for complete search history.

(56) References Cited

U.S. PATENT DOCUMENTS

| | | | | | |
|---|---|---|---|---|---|
| 183,045 | A | * | 10/1876 | Dunlop | 441/58 |
| D263,860 | S | * | 4/1982 | Cole | D21/770 |
| 4,932,911 | A | * | 6/1990 | Albrecht | 441/56 |
| 5,275,860 | A | * | 1/1994 | D'Luzansky et al. | 428/71 |
| D683,414 | S | * | 5/2013 | Bell | D21/806 |
| 2008/0160848 | A1 | * | 7/2008 | French | 441/75 |

* cited by examiner

*Primary Examiner* — Edwin Swinehart
(74) *Attorney, Agent, or Firm* — Eric Hanscom; Todd J. Langford

(57) ABSTRACT

A handboard for body surfing waves is described. The handboard has an adjustable strap that can be tightened or loosened depending on the size of the user's hand and the anticipated turbulence that the user expects to find in the surf. The strap is screwed into mated holes in the deck of the handboard, and there are several sets of screws so that a user can adjust the position of the strap on the handboard, thereby allowing a user to move the strap up or down the handboard depending on how he/she wants to trim the handboard. The handboard has a leash plug so that a user can be attached to the handboard, and an attachment site to which cameras and other accessories can be attached.

9 Claims, 5 Drawing Sheets

HANDBOARD

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of wave-riding devices, and more specifically, to a handboard that bodysurfers can attach to their hands to facilitate riding waves.

To summarize the invention, the handboard is custom shaped from the same materials from which epoxy surfboards are made. Beginning with a foam blank, or pieces or wood or some other substance suitable for shaping, the handboard is shaped by surfboard-shaping tools that are known in the art such as saws, power planers, sanding blocks and screens. After the board is shaped, various advertising insignia and/or decorative features can be added through placing a rice paper decal on the foam, or using masking tape or a similar means to delineate a pattern, over which optionally colored resin mixed with a catalyst is spread. Alternative methods for adding advertising insignia and/or decorative features are contemplated, such as decals that are heat transfer printed and placed over the top of the epoxy board. After the resin has cured, one or more layers of fiberglass cloth, of one or more thicknesses, is then laid over one side of the handboard and a layer of laminating resin with catalyst is squeegeed over the fiberglass. The excess cloth is then cut away after the resin hardens, and the process is repeated on the opposite side. Then, a layer of sanding resin, again with catalyst, is painted over one side of the board and allowed to dry. After the other side of the handboard is then also coated with sanding resin, the resin is allowed to dry until it is sanded, producing a smooth finish. Gloss coats are then applied to both sides, allowed to dry, and finally the handboard is buffed out with a combination of wet-and-dry sandpaper and buffing compound.

Because each handboard can be custom made, it allows the creator of the handboard to add a number of features that can impact the performance of the handboard in the ocean waves. For example, but not by way of limitation, the shaper can create one or more "wings" that are protrusions of the side of the handboard, or a "rail" that digs into the face of the wave, allowing the bodysurfer a more secure grip on the wave face. The creator of the handboard can also insert one or more sets of screw holes at various locations, allowing the bodysurfer to move one or more hand straps to different locations depending on the wave size and performance characteristics desired. For example, putting weight on the back of a planning device, such as a handboard or surfboard, maximizes maneuverability at the expense of speed, which moving the weight forward, to "trim" the board, allows the surfer or bodysurfer to travel more rapidly, but with a less control. The bottom configuration of a planning surface, such as a surfboard or handboard, is also crucial to the performance of the board, as the channeling of water affects many aspects of a board's maneuverability—such as when the shaper builds a concave "V" into the bottom of the board, and the general curvature of the bottom—the "rocker"—affects where weight must be applied to maximize performance and/or speed. The custom-shaping also allows for selective attachment of accessories, such as leash plugs for attaching the handboard to a wrist or forearm via a leash.

Riding ocean waves has roots back many hundreds of years. The evolution of handboards for body surfing has resulted in several hand paddles for swimming—not bodysurfing—and several handboards made from single plastic molds. While these models have improved the user's ability to participate in swimming and bodysurfing, the prior art lacks a handboard that is made in a custom manner, like a surfboard, with a variety of design features. The heavy plastic handboards have an additional limitation in that their weight makes them less effective than a lighter handboard would perform.

Thus there has existed a long-felt need for a handboard that is custom shaped, made out of foam/fiberglass/resin, like a surfboard, and with a number of optional features.

SUMMARY OF THE INVENTION

The current invention provides just such a solution by having an adjustable handboard that is custom shaped, just like a surfboard, and from similar materials to the foam blanks, resin and fiberglass from which surfboards are made. As the handboard is being shaped, the shaper can personalize the board to the rider, depending on the size, weight, and ability level of the rider, expected size and types of waves ridden, etc. The shaper can customize the bottom rocker, put concave channels into the bottom, put one or more wings along with rails of the handboard, and customize the handboard in other ways as well. The maker of the handboard can also locate multiple screw holes for adjusting the position of the hand on the handboard in various locations, again, depending on the expected user and wave conditions, such that the user can personally adjust the location of his/her hand on the handboard depending on changing wave conditions. There is also a leash plug for attaching the handboard to a wrist or forearm via a leash. Because each handboard is custom shaped, different configurations of rocker, rail hardness, length, width and other features may be used to create a handboard made for particular types of bodysurfers.

It is a principal object of the invention to provide a custom-shaped handboard that can be built with a specific user and wave condition in mind.

It is another object of the invention to provide an improved means of bodysurfing.

It is a further object of this invention to provide a device for aiding individuals in wave riding.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
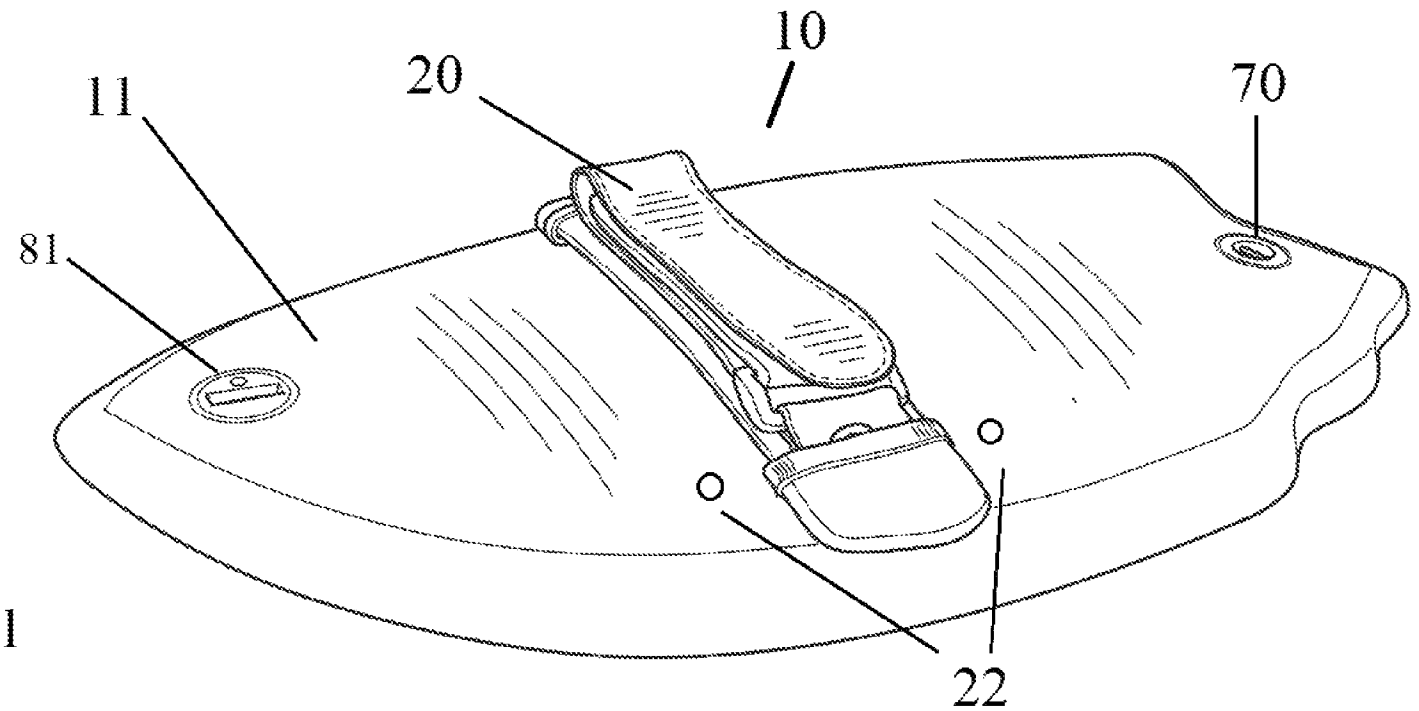
FIG. 1 is a perspective view of a handboard according to selected embodiments of the current disclosure.
Figure 2:
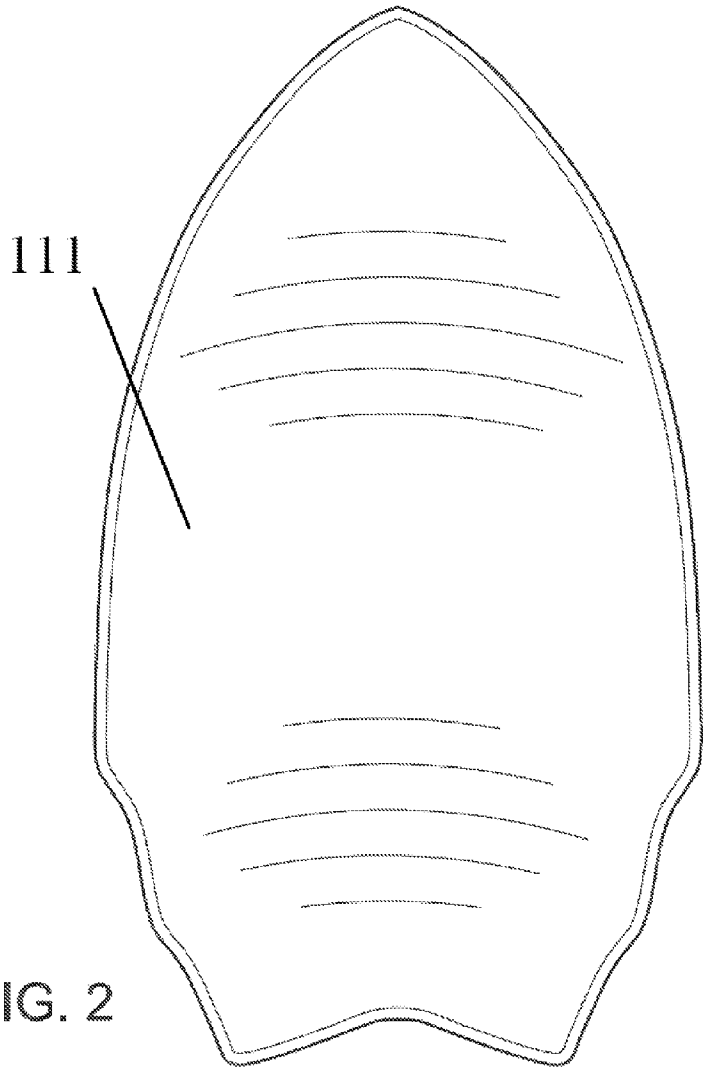
FIG. 2 is a bottom perspective view of a handboard according to selected embodiments of the current disclosure.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a perspective view of a handboard being worn by a user according to selected embodiments of the current disclosure. The handboard, generally reference by reference number 10, includes a hand strap 20 affixed to the handboard body 11. The hand strap 20 helps secure the handboard 10 to a user's hand. The user places his or her hand through the hand strap 20, thereby securing the handboard 10, to the user's hand. As an additional means of securing the handboard 10 to the user, an optional leash can be attached to the handboard by a leash plug 70 inserted into an accessory anchor point in the handboard body 11. The leash is very similar to a surf leash, well known in the industry of surfboards, which has a strap that is secured around the arm of a user and a stretchable cord that secures the board (or in this case the hanbdboard) to the user. The handboard also has an attachment site 81 at which a variety of accessories can be attached, of which a small, waterproof camera is one of the most important. The hand strap 20 is secured to the handboard 10 by means of screws (not shown, but are standard machine screws). The screws pass through screw holes in the hand strap 20 and into screw holes 22 in the handboard body 11. Screw holes 22 are threaded to mate with screws. Additional screw holes 22 in the handboard body 11 allow the hand strap 20 to be placed at various positions along the length of the handboard, which will help the user "trim" the handboard so it is planning at a desired angle.

Figure 4:
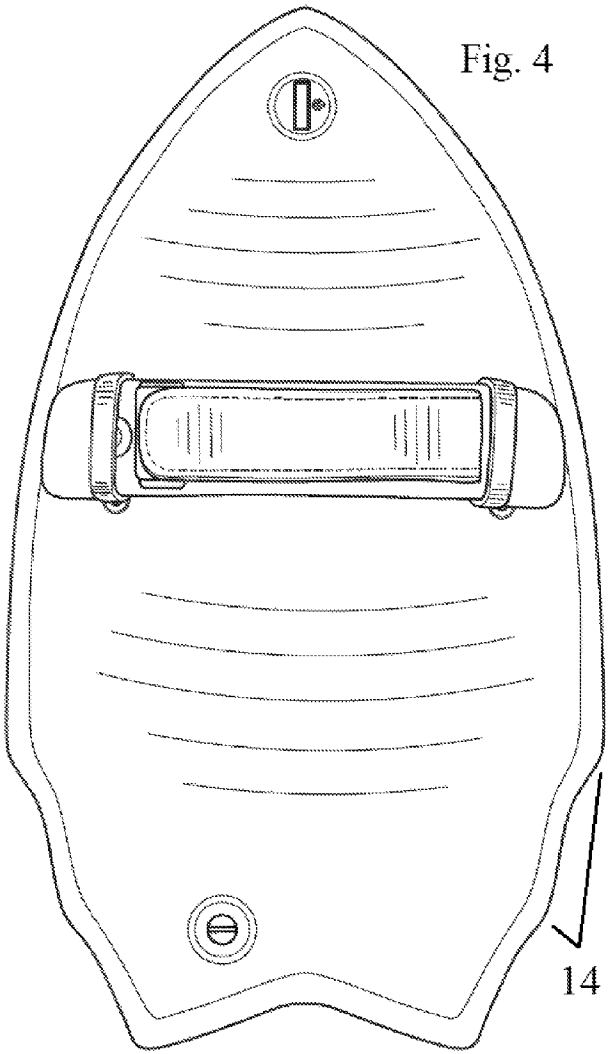
FIG. 4 is a top view of a handboard according to selected embodiments of the current disclosure.

FIG. 4 is a bottom view of a handboard according to selected embodiments of the current disclosure. The bottom 11 of the handboard body is a smooth surface with a low coefficient of friction to allow the handboard 10 to travel through water with as little resistance as possible. The bottom 11 can be other than a flat surface on both horizontal and vertical axes.

Figure 3:
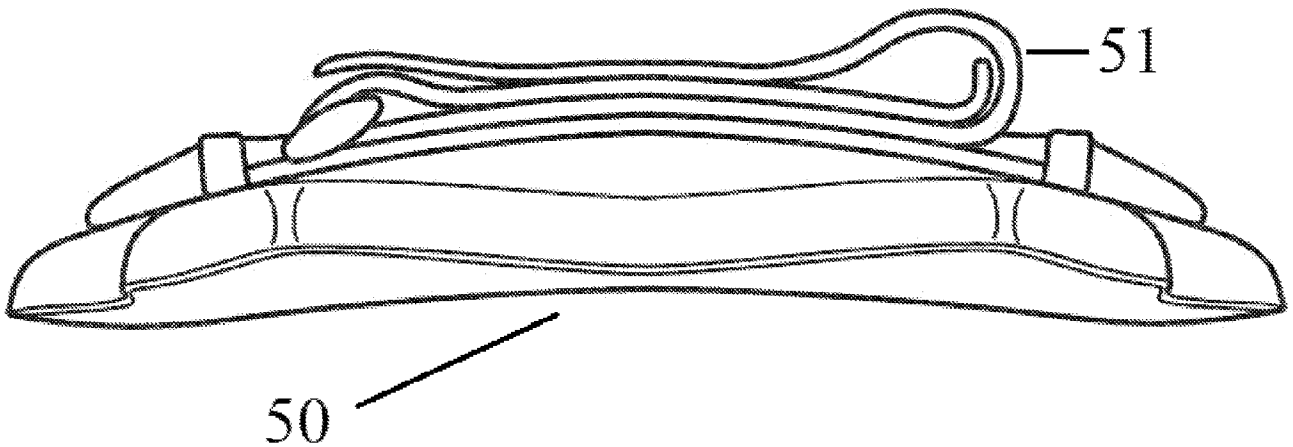
FIG. 3 is a back view of a handboard with a hand strap according to selected embodiments of the current disclosure.

FIG. 3 is a back view of a handboard according to selected embodiments of the current disclosure. In this particular embodiment of the invention, the bottom of the handboard body has a lateral concave curve, which serves to channel water through the handboard as it planes across the surface of a wave. This figure also illustrates the "fold-back" 51 mechanism by which the strap of the handboard works. Hook and loop fasteners of opposite sides of the strap allow a user to adjust the amount of space between the strap and the upper surface of the handboard.

FIG. 4 is a top view of a handboard according to selected embodiments of the current disclosure, which in this embodiment show one or more wings 14, which are protrusions that extend from the side of the handboard.

Figure 5:
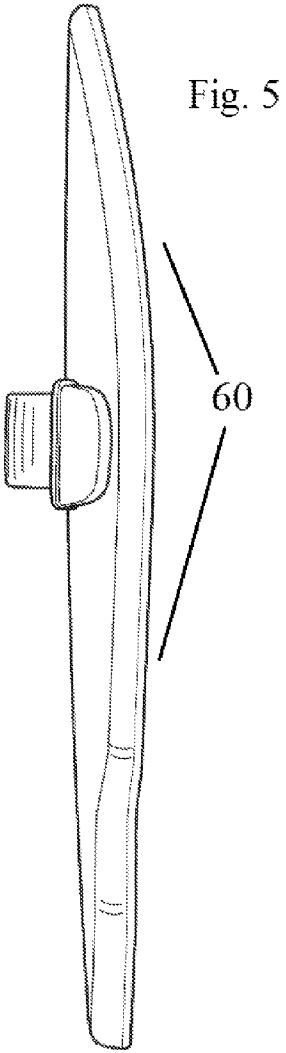
FIG. 5 is a side view of a handboard according to selected embodiments of the current disclosure.

FIG. 5 is a side view of a handboard according to selected embodiments of the current disclosure. The nose of the handboard body narrows and curves upwards as it approaches the front of the handboard body. This vertical curvature of the bottom of the handboard is called the "rocker".

In a selected embodiment of the current invention, the handboard body is 12 cm wide and 50 cm long with an overall thickness of 3 cm. There is a distance of 7 cm between the screw holes 22 on the left side of the handboard body 11 and the screw holes 22 on the right side of the handboard body 11. The weight of the handboard body should be between 370 g and 400 g, with the accessories, hand strap, and screws adding additional weight accordingly. In another selected embodiment of the current invention, the handboard body is 26 cm wide and 47 cm long with an overall thickness of 3 cm.

As stated earlier, the handboard body preferably has a curved pointed nose and a fish tale. The nose rises about 4.4 cm and the tail rises about 1.9 cm. The bottom of the handboard body has a single concave curvature rising a maximum of about 0.6 cm.

The handboard body is made from the same procedures as that of a regular surfboard. It has a molded hi-density EPS foam core with a composite PVC stringer running longitudinally therethrough. The EPS foam core is surrounded by layers of (in order) epoxy resin, reinforcement fabric, epoxy resin, reinforcement fabric, epoxy resin, microlite filler, paint layer, and a protective layer. The EPS foam core and eight layers provide a strong handboard body with a fiberglass hull that has a glossy finish with optional graphics on both the top and bottom.

An alternative method of manufacture is also contemplated, where a block of wood, or a block of strips of wood adhered to each other, are shaped into the final handboard shape, resulting in a visually attractive handboard.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A wave-riding device consisting of:

a handboard body and a hand strap, where the hand strap is secured to the handboard body, further comprising two screws, wherein the handboard body comprises a plurality of screw holes, where the two screws secure the hand strap to the handboard body and mate with the screw holes in the handboard body, wherein the handboard body comprises an attachment site, where the attachment site is located on the top side of the handboard towards the front of the handboard, further comprising a leash plug, where the leash plug is located on the top side of the handboard towards the rear of the handboard, wherein the handboard body additionally comprises a plurality of wings, wherein the handboard body comprises a fish tail, wherein the bottom of the handboard body comprises a single concave curve, wherein the bottom of the handboard body comprises a degree of rocker equal or greater to ½".

2. The wave-riding device of claim 1, where the degree of rocker is equal to ½".

3. The wave-riding device of claim 1, where the degree of rocker is equal to 1".

4. The wave-riding device of claim 1, where the degree of rocker is equal to 1½".

5. The wave-riding device of claim 1, where the degree of rocker is equal to or greater than 1".

6. The wave-riding device of claim 1, where the degree of rocker is equal to or greater than 1½".

7. The wave-riding device of claim 1, where the degree of rocker is greater than ½".

8. The wave-riding device of claim 1, where the degree of rocker is greater than 1".

9. The wave-riding device of claim 1, where the degree of rocker is greater than 1½".

* * * * *